US005525963A

United States Patent [19]

Purssey

[11] Patent Number: 5,525,963

[45] Date of Patent: Jun. 11, 1996

[54] APPARATUS FOR ACTUATING A SAFETY DEVICE

[76] Inventor: Neil K. W. Purssey, Ty-Bryn, Poynters Road, Hatchford, Cobham, Surrey, England, KT11 1PQ

[21] Appl. No.: 318,619

[22] PCT Filed: Apr. 7, 1993

[86] PCT No.: PCT/GB93/00741

§ 371 Date: Oct. 7, 1994

§ 102(e) Date: Oct. 7, 1994

[87] PCT Pub. No.: WO93/20317

PCT Pub. Date: Oct. 14, 1993

[30] Foreign Application Priority Data

Apr. 7, 1992 [GB] United Kingdom ..... 9207670

[51] Int. Cl.[6] ..... G08B 23/00

[52] U.S. Cl. ..... 340/540; 49/31; 292/92; 340/531; 340/636

[58] Field of Search ..... 340/540, 531, 340/636; 49/31; 292/92

[56] References Cited

U.S. PATENT DOCUMENTS

| | | | |
|---|---|---|---|
| 3,207,273 | 9/1965 | Jurin | 49/31 |
| 3,988,891 | 11/1976 | Hoyler | 60/288 |
| 4,011,716 | 3/1977 | Smith | 60/39.281 |
| 4,198,938 | 4/1980 | Harada | 123/407 |
| 4,344,144 | 8/1982 | Damico et al. | 364/510 |
| 4,520,503 | 5/1985 | Kirst et al. | 381/56 |
| 5,001,466 | 3/1991 | Orlinsky et al. | 340/540 |
| 5,012,223 | 4/1991 | Griebell et al. | 340/531 |
| 5,072,973 | 12/1991 | Gudgel et al. | 49/31 |

FOREIGN PATENT DOCUMENTS

| | | |
|---|---|---|
| 388379 | 9/1990 | European Pat. Off. . |
| 2446912 | 8/1980 | France . |
| 2818185 | 11/1979 | Germany . |
| 3620815 | 12/1987 | Germany . |
| 4008408 | 9/1991 | Germany . |
| 312096 | 2/1956 | Switzerland . |
| 1570260 | 6/1980 | United Kingdom . |

OTHER PUBLICATIONS

Front page of the British Standard on the subject, entitled "Electrically Operated Gas Shut–Offi Valves" dated Aug. 1981.

Page from a product brochure of IMI Webber Limited of City Business Park, Easton Road, Bristol BS5 0SP, UK, May 1979.

*Primary Examiner*—Glen Swann

*Attorney, Agent, or Firm*—Nixon & Vanderhye

[57] ABSTRACT

Apparatus for actuating a safety device comprises an acoustic sensor and apparatus coupled to the sensor for actuating the safety device in response to sound of a predetermined character. Apparatus for releasing or closing a closure is also disclosed. Three embodiments of the apparatus are disclosed.

36 Claims, 8 Drawing Sheets

APPARATUS FOR ACTUATING A SAFETY DEVICE

BACKGROUND OF THE INVENTION

1. Field of the Invention

This invention relates to apparatus for actuating a safety device, and more particularly for actuating a door release arrangement on a device for holding open doors such as fire doors in the event of a fire alarm being raised. Such a holding device is referred to herein as a "door holder". The invention also relates to apparatus for releasing or closing a closure (such as a door).

2. Related Art

Door holders are available in several forms. A simple hook and eye is most popular, with other devices using friction between the floor and a rubbing surface. There are magnetic types available which consist of two parts with attracting polarities, one being fixed to the door and the other to an adjacent surface.

Some such magnetic types are electromagnetic with the supply current being connected via an appropriate fire alarm system. The door release arrangement is hard-wired into the system in such a way that it acts to cut the electric supply to the electromagnet on activation of the fire alarm. Hence the door is allowed to close and thus form part of a safety fire break.

Electromagnetic door holders including such a door release arrangement are, however, expensive and complicated to fit, especially retrospectively. Consequently many fire doors are permanently held open with any suitable object that may be to hand. This is often, ironically, a fire extinguisher.

It is known from U.S. Pat. No. 4,520,503 to provide a tone discrimination circuit for use with audible smoke or fire detectors or similar audible devices, which automatically emits an output electronic alarm signal, for notification of persons at remote locations, upon input of a proper audio tone from the smoke detector or other audible device. The circuit contains in series a microphone, a two stage audio amplifier, a frequency detector, and a tone discrimination circuit. The circuit emits an output electronic alarm signal if and only if the audio input signal has sufficient amplitude, the desired frequency, and the desired duration.

SUMMARY OF THE INVENTION

According to the present invention, there is provided apparatus for retaining and releasing a closure, comprising retaining means actuable between a retaining state in which it can retain the closure open and a release state in which it ceases to retain the closure and hence releases it, a sensor for sensing from the ambient medium an alarm signal transmitted into the ambient medium, and means coupled to the sensor for actuating the retaining means to release the closure in response to the alarm signal.

According to a closely related aspect of the present invention, there is provided valve apparatus comprising a valve, a sensor for sensing from the ambient medium an alarm signal transmitted into the ambient medium, and actuating means coupled to the sensor for closing the valve in response to the alarm signal.

According to a preferred aspect of the present invention, there is provided apparatus for actuating a safety device, comprising an acoustic sensor and means coupled to the sensor for actuating the safety device in response to sound of a predetermined character.

Thus, in the case of a fire alarm system, for example, by actuating the safety device in response to sound of a predetermined character (typically the sound of fire alarm), a hard-wired link with the fire alarm system can be avoided. Hence the apparatus can be relatively cheap to instal and relatively easily fitted to react to existing fire alarm systems.

Preferably, the actuating means is adapted to actuate the safety device only in response to sound in one or more predetermined, preferably audible, frequency ranges, of a predetermined continuous duration and above a predetermined intensity threshold. If the above characteristics are carefully chosen, the apparatus can be highly discriminatory against sounds (even loud sounds) which do not emanate from fire alarms, and highly selective of sounds which do emanate from such alarms.

The invention extends to the aforesaid apparatus in combination with the safety device. The safety device may be or be part of a door holder or door closer and is hence conveniently actuable to permit release of a closure (for example, fire door). Again, the safety device may be actuable to close a valve, such as a valve on a gas line. Again, it may be an electrical switch, such as could turn off a mains electricity supply.

Preferably, the apparatus includes means for overriding the actuating means to permit actuation of the safety device at will. This feature has the advantage not only of convenience but also of safety. In the event of failure of the actuating means, it may be important, for example, to be able to close a closure by hand.

If, as is preferred, the safety device includes an engagement formation for holding a closure open and being actuable by the actuating means to permit release of the closure, the override means is preferably adapted to permit actuation of the safety device in response to force applied to the engagement formation. This can afford a particularly simple way of permitting actuation of the safety device at will, since the closure need only be pushed open or closed for the safety device to be actuated.

Preferably, the override means is adapted to permit actuation of the safety device both in response to an opening force and in response to a closing force applied to the engagement formation in respective mutually opposed directions. This is an important safety feature. Whichever way the door is moved (open or closed), the safety device can be actuated. Thus, for example, a person could not inadvertently become locked in a room by the safety device.

In the preferred embodiment, the override means is adapted to permit retraction of the engagement formation towards the body of the apparatus in response to force applied to the formation. More preferably, the engagement formation is pivotable, pivoting of the formation being arranged to cause its retraction. These features are a simple and convenient way of putting the invention into practice.

The apparatus may include a battery holder arranged to supply battery power to the actuating means. If so, and if an access door to the battery holder is provided, preferably the actuating means is arranged to actuate the safety device on opening of the access door. This is an anti-tamper feature. The apparatus also preferably includes a battery condition sensor (such as a voltage sensor), the actuating means being arranged to actuate the safety device if a low battery condition is sensed. This is a fail-safe safety feature, which can, for example, permit release of the closure if a low battery condition is sensed. The apparatus further preferably includes means for switching off power to the actuating means once the safety device has been actuated. This can conserve battery power, even in circumstances when the fire alarm (for example) is continuing to sound.

Another preferred feature which can conserve battery power is the inclusion in the actuating means of a bistable, preferably electro-mechanical, actuator. Whether it is on (actuating) or off (non-actuating), it does not consume power (or only consumes negligible amounts). Power is only consumed in changing the actuator from one state to the other.

The safety device may include an engagement formation for holding the closure open and being actuable by the actuation means to permit release of the closure.

In one preferred embodiment the engagement formation is capable of engagement with a cooperating engagement formation. The cooperating formation could be mounted on the closure, whilst the main body of the apparatus could be mounted adjacent the closure. This obviates the need to mount the entire apparatus on the door. The apparatus could be mounted at a significant height above the floor, which would have the advantage that it could not be easily broken or tampered with.

In another preferred embodiment, the engagement formation is capable of frictional engagement with the ground. This embodiment is suitable for door-mounted use. In this embodiment, preferably the engagement formation has an adjustable reach. Hence the clearance of the apparatus above the ground need not be critical.

The invention extends to apparatus as aforesaid in combination with the closure. It may also extend to a method of actuating a safety device, the method comprising features analogous to the apparatus features described above.

According to another aspect this invention provides a door holder that has an integral remotely released mechanism. The holder is manually operated to maintain a door in an open position by friction pressure between the holder stay and the floor. A clasp and spring provide both hold and release function. Connected to the clasp is an electro-mechanical device which when energized moves the clasp and allows the stay to release whereby the door may swing to close.

The power is provided from a battery within the holder, via a switch which is activated remotely by the fire alarm being sounded. The electro-mechanical device may be a solenoid or motor (for example, a servo or stepper motor). The switch may be activated by sound and/or radio waves. The invention could either form part of or be independent from a door closer.

The integral power of the unit may be switched by an Audio and/or a Radio Signal switching device. The holder may form an integral part of a door self closing device.

It will be appreciated that many of the above features may be provided independently, where appropriate.

BRIEF DESCRIPTION OF THE DRAWINGS

Preferred features of the invention are now described, by way of example only, with reference to the accompanying drawings, in which.

DETAILED DESCRIPTION OF EXEMPLARY EMBODIMENTS

Figure 1:
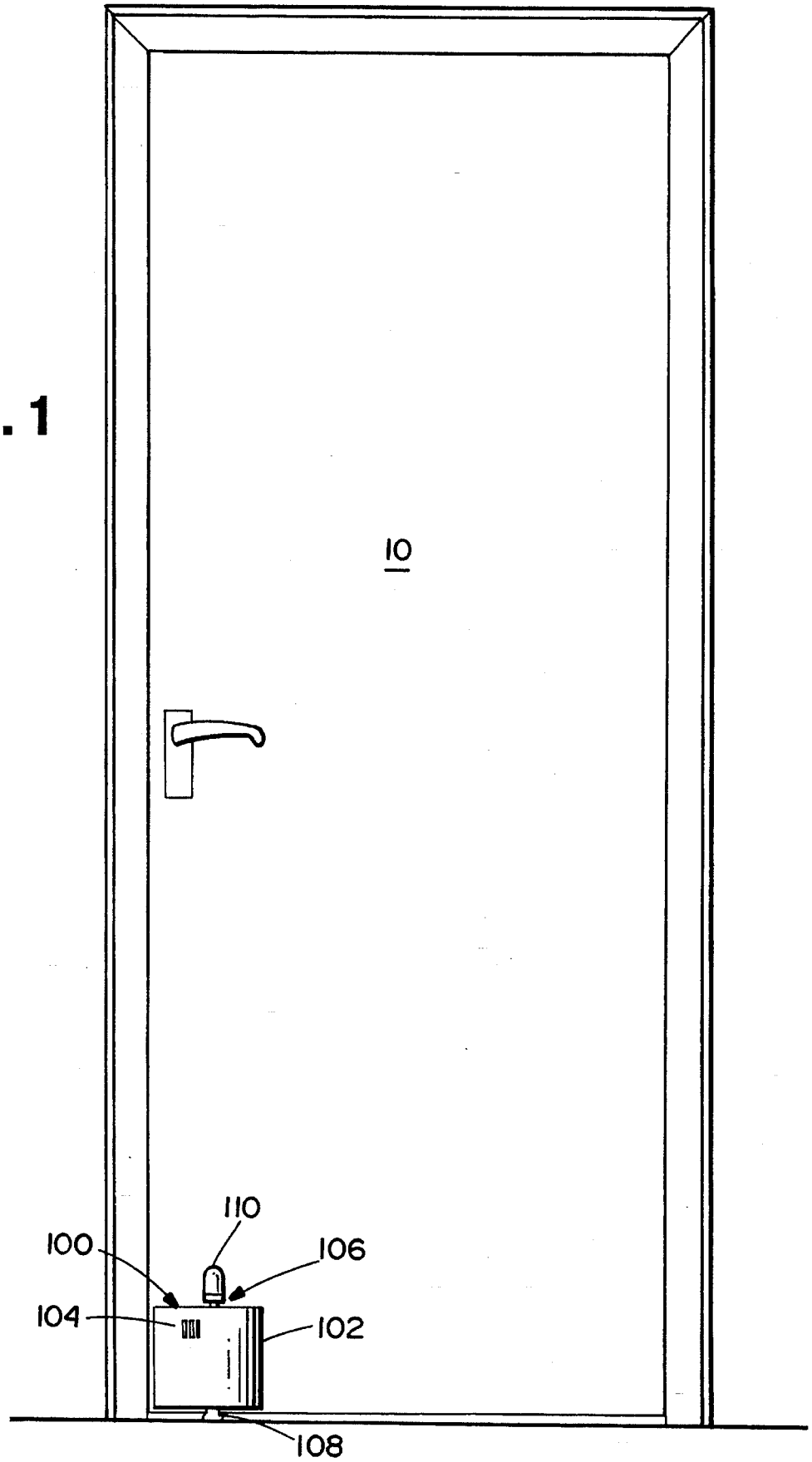
FIG. 1 shows a first embodiment of door holder according to the present invention mounted on a door, the door being closed and the door holder being viewed in front elevation.
Figure 2:
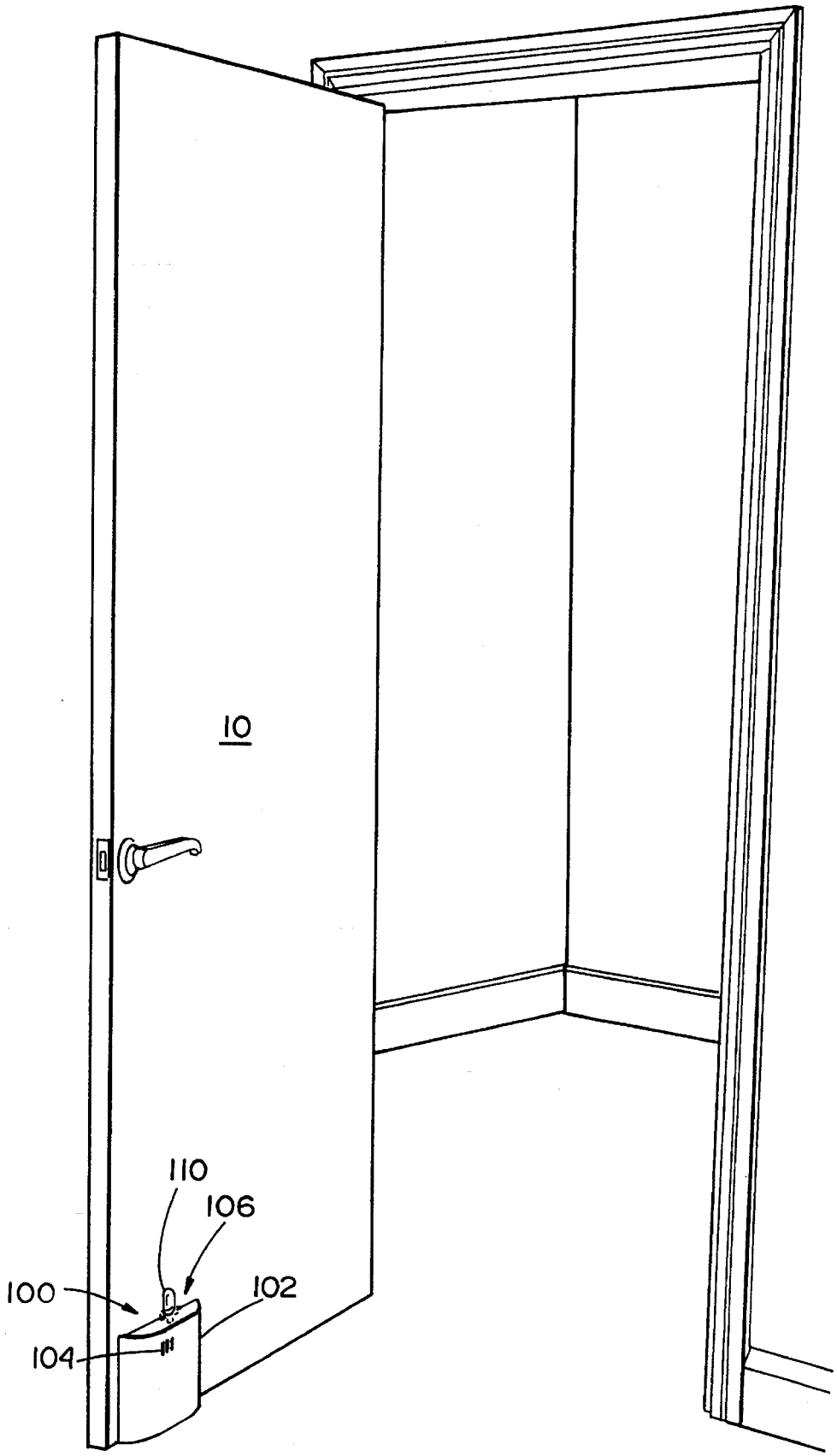
FIG. 2 is a view similar to that of FIG. 1, but showing the door open and the door holder viewed in perspective.

Referring first to FIGS. 1 and 2, a first embodiment of door holder 100 includes generally a body 102 (only the casing of which is visible in FIGS. 1 and 2) affixed to a door 10, a microphone 104, a plunger 106 including on one end a foot 108 for engaging the ground and at the other end a push knob 110, a holding arrangement (not shown in FIGS. 1 and 2) for keeping the plunger engaged with the ground and hence for holding the door, a release arrangement (also not shown) for releasing the plunger and hence the door, and means (again not shown) for actuating the door release arrangement in response to sound of a predetermined character sensed by the microphone 104. References to the actuating means are to be taken to include reference to the holding and release arrangements where the context so demands.

In use the door is held open by depressing the plunger 106 using the push knob 110 to engage firmly with the ground. The plunger is maintained automatically in position by the holding arrangement. If a fire alarm sounds, this sound is sensed by the microphone 104 and passed to the actuating means which actuates the release arrangement to release the plunger. If, as is invariably the case with fire doors, the door is biassed towards the closed position, the door then automatically closes.

Figure 3:
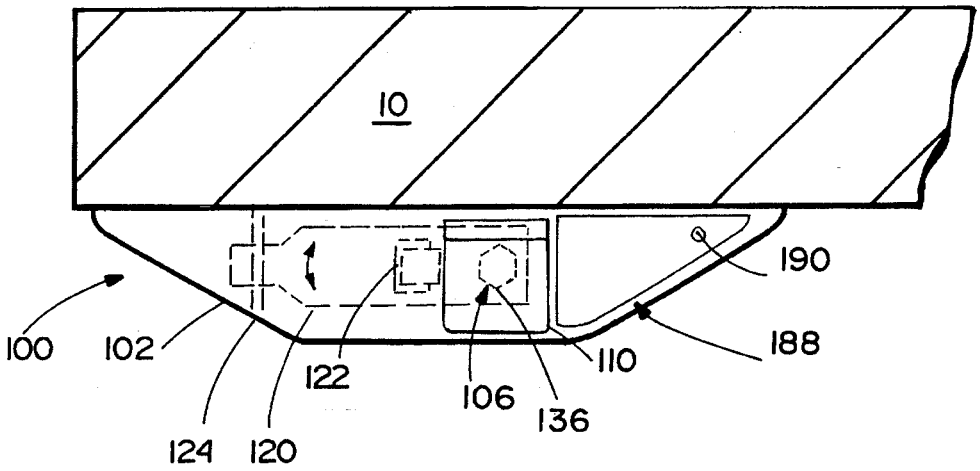
FIG. 3 is a plan view of the holder, again mounted on the door.

The door holder is now discussed in more detail with reference to FIGS. 3 and 4. The holding arrangement includes a clasp 120 and a retaining bracket 122 about which the clasp is free to pivot in all directions (as shown by the respective arrows in FIGS. 3 and 4). Pivoting of the clasp is limited both in the horizontal and in the vertical planes by abutment member 124, one end of the clasp riding over a shaped surface on this member. The plunger 106 is slidable in upper and lower guide brackets 126 and 128, and is biassed upwardly by coil spring 130 which is attached to the plunger at its upper end with pin 132 and bears at its lower end against the lower guide bracket 128. Upward travel of the plunger is limited by stop 134. The shank of the plunger, which is hexagonal in cross-section, fits though a hexagonal hole 136 in the clasp 120 slightly larger than the shank cross-section.

It will be understood that the clasp 120 can grip or release the plunger 106 according to its angle relative to the plunger.

Hence, when the plunger is depressed, the portion of the clasp adjacent the hole 136 is moved slightly downwardly, and the plunger is free to continue to move downwardly. When pressure on the plunger is released, the spring 130 moves the plunger and the relevant portion of the clasp slightly upwardly, so that the plunger is then locked in position.

It will be appreciated that the holding arrangement described above allows the plunger to be adjustable for reach, so that different heights of door holder relative to the ground can be easily accommodated.

In this embodiment, release of the plunger can be effected not only via the actuating means but also, by way of overriding the actuating means, by opening or closing the door. This is achieved as follows. The lower guide bracket 128 has a guide hole nearly the same size as the cross-section of the plunger 106 and hence acts as a fulcrum for the plunger. On the other hand, the upper guide bracket 126 has a rectangular slot, the narrow sides of which are parallel to the direction of movement of the door holder as the door is opened or closed. The narrow sides form a close fit with the plunger. Hence the plunger is free to rock somewhat when the door is opened or closed via an opening or closing force applied to the foot 108. Rocking movement of the plunger in turn causes the clasp 120 to pivot about a vertical axis. The shaped surface on the abutment member 124 curves upwardly towards each end.

Hence pivoting of the clasp to an off-centre position causes that end of the clasp engaged with the abutment member to rise somewhat, which releases the plunger. The plunger then rises under the action of the spring 130. In this way movement of the door releases the plunger.

In a variant of the first embodiment, the abutment member 124 includes a slit. The clearance between the upper and lower surfaces of the slit in the abutment member is screw-adjustable in order that the sensitivity of triggering of the clasp may be adjusted.

Figure 4:
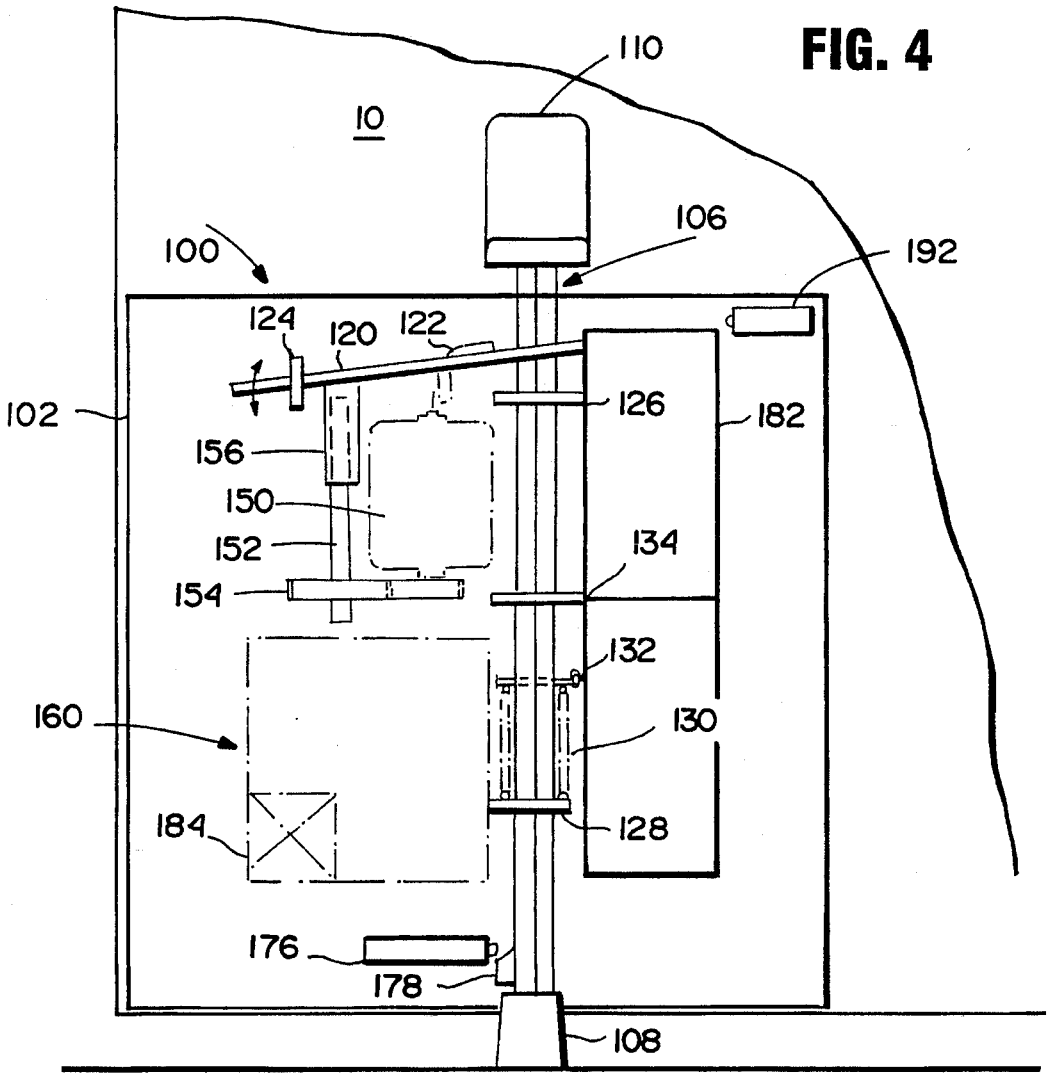
FIG. 4 is a partial front elevational view of the holder showing the interior of the holder.

Referring to FIG. 4, the release arrangement (actuated by the actuating means) includes a motor 150, powered by the actuating means, driving a threaded rod 152 via a reduction gearing mechanism 154. The threaded rod screws into and out of a corresponding threaded sleeve 156 which abuts the clasp 120 and is restrained from rotating, so that the clasp 120 pivots about a horizontal axis. Hence rotation of the motor 150 causes the clasp to hold or release the plunger 106 according to its direction of rotation. If the plunger is released by the clasp, the spring 130 acts to retract the plunger back to its release position at which it in turn releases the door.

The actuating means is arranged to supply electrical pulses to the motor 150 of sufficient duration that it can drive the threaded sleeve 156 from one extreme of travel to the other. For the remainder of the time, power is not supplied to the motor.

In an alternative embodiment of the release arrangement, instead of including an electric motor, the arrangement comprises a permanent magnet (possibly of the rare earth type) on the clasp and a permanent magnet of a type which can have its polarity switched by an electrical pulse of only modest power. Such a magnet may suitably be made of Strontium, Barium Ferrite, Neodymium-Iron-Boron, or Samarium Ferrite. The permanent magnet is so located on the clasp that it is moveable with the clasp between the poles of the switchable permanent magnet. Thus the permanent magnet on the clasp and hence the clasp can be attracted to one or other of the poles of the switchable magnet according to its polarisation at any particular time. The movement of the clasp produced by switching the permanent magnet is arranged to hold or release the plunger as appropriate.

In another alternative embodiment of the release arrangement, the arrangement includes a bistable latch of the type found on retractable ball-point pens or on catches for loft doors, to hold the clasp selectively in its hold and release states. The latch would be powered by a solenoid.

In fact, it will be apparent that any suitable kind of bistable electro-mechanical device would be advantageous, in that it is advantageous not to consume power in performing the hold or release functions, but only to consume it in changing state from one function to the other. Other suitable types of bistable actuators would be remanence solenoid, latching solenoid or opposed solenoid actuators.

The actuating means is now described with reference to FIGS. 3 to 5. It is shown as 160 in FIG. 4 and includes various components mounted on a Printed Circuit Board.

In one part of the actuating means, the output from microphone 104 is amplified in amplifier 162 and then passed to a means for determining whether the alarm signal (sound) is of the predetermined character. This means comprises a rectifier and filter circuit 164 and a comparator 166. The rectifier and filter circuit filters out any signals outside the range 500–1000 Hertz. The filtered signal is then passed to the comparator 166 and compared with a threshold duration (5 seconds) and a threshold intensity (65 decibels) stored in threshold storage 168. Any signal which exceeds these thresholds is passed through OR gate 170 to the positive drive of monostable 172, and thence via bridge driver 174 to the motor 150. Hence any sound of the predetermined character described above triggers the actuating means to actuate the release arrangement to release the plunger 106 and thus release the door.

The characteristics of the sound which are tested for may be varied according to what sound it is intended that the door holder should respond to. For example, fire alarms in many countries are required by law to produce sound of a particular type. The characteristics which are tested for may need to be varied accordingly. As a guideline, the frequency of a conventional fire alarm sound is usually between 100 and 3000 Hz, the duration at least two seconds, and the intensity at least 55 or 60 decibels, although higher intensities are most usual. Other values of these parameters are naturally possible. If the alarm sound has two fundamental frequencies, the number of false positives may be reduced by testing separately at both frequencies.

Figure 5:
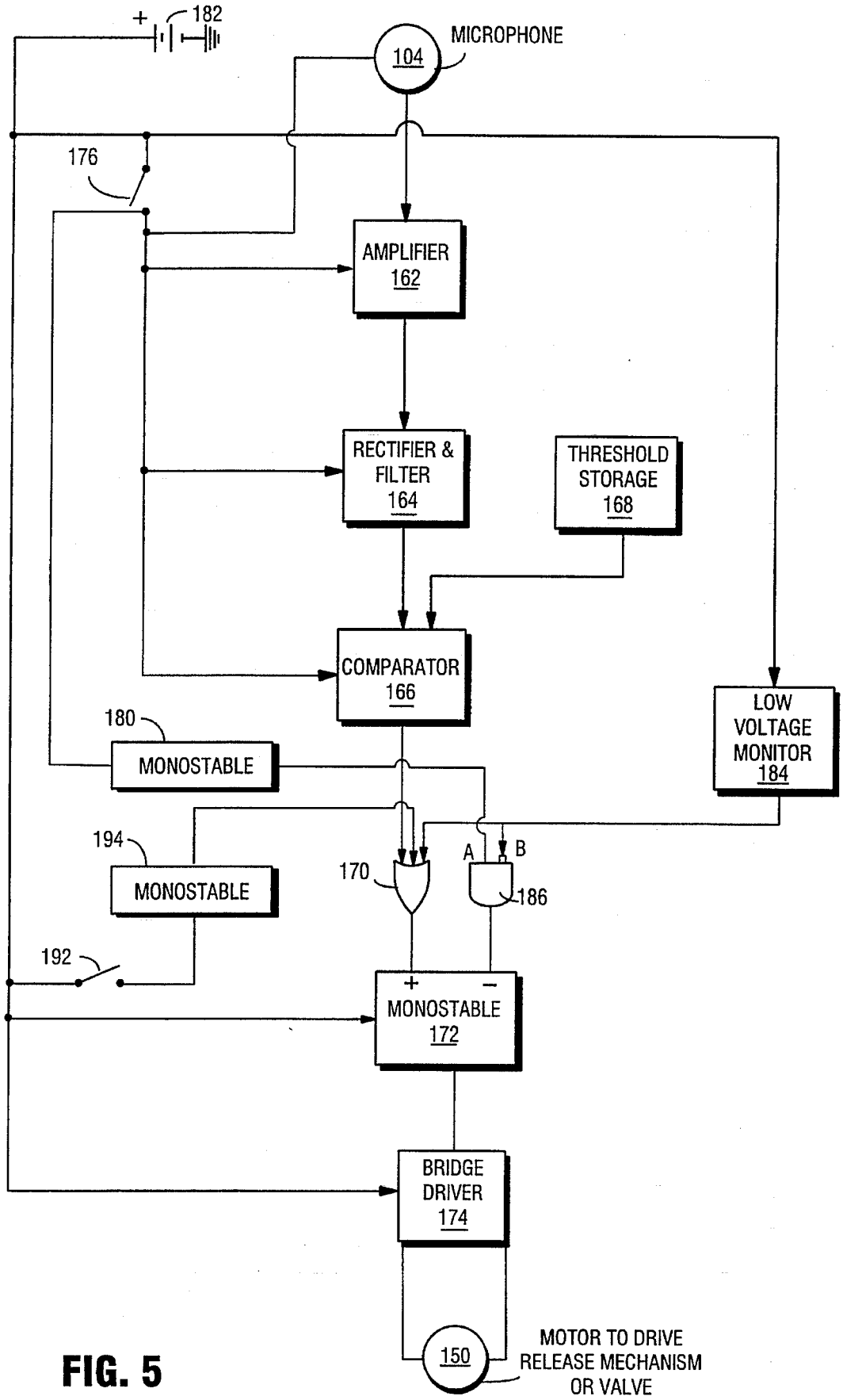
FIG. 5 is a block diagram of the holder, showing particularly an actuating means.

As is clear from FIG. 5, power is only supplied to the major components of the actuating means and to the motor 150 when main micro-switch 176 is closed. As can be seen from FIG. 4, this switch is open unless formation 178 on the plunger 106 closes the switch, which occurs only when the plunger is depressed. Hence the depressed position of the plunger is effectively the "standby" state for the actuating means, whilst the release position is effectively the "off" state. Thus after an appropriate sound has caused the actuating means to actuate the motor the actuating means and motor will be turned off even if the sound persists, so that current drain then falls to nil or some negligible quiescent value (typically 30 μA).

After actuation, the motor 150 resets the clasp 120 when the plunger 106 is depressed. Depression closes the switch 176, which in turn triggers monostable 180 and hence drives the motor in reverse via the negative drive of monostable 172. The reset clasp can then again hold the plunger in the depressed position.

The actuating means 160 is battery-powered and includes a battery holder 182. The door holder is designed to function on a single set of batteries for at least a year. Also provided is a battery voltage monitor 184 which produces an output signal if the battery voltage falls below a preset fail-safe threshold. The output of the monitor 184 is fed via the OR gate 170 to the positive drive of the monostable 172. Hence if a low battery voltage signal is produced the plunger 106 is released, so that the door is free to close. Furthermore, the low battery voltage signal is passed to the "B" (inverting) input of AND gate 186, whose other input "A" is coupled to the switch 176 via monostable 180. The AND gate output goes active when A is active and B is inactive. Thus a low battery voltage signal will disable the negative drive of the monostable 72 and thereby prevent resetting of the clasp 120. Therefore once a low battery voltage condition has been detected, the actuating means acts to release and keep released the plunger 106. The door holder remains inoperational until fresh batteries have been inserted. This is a fail-safe feature.

Another safety feature is that the clasp 120 is released if the access door 188 to the battery compartment is tampered with. To open the access door it is necessary to unscrew screw 190. However, unscrewing of this screw is arranged to turn access door micro-switch 192 on. This triggers monostable 194 which acts to release the plunger 106. The door holder cannot be operated again until the access door is replaced (and the batteries are in place).

Figure 6:
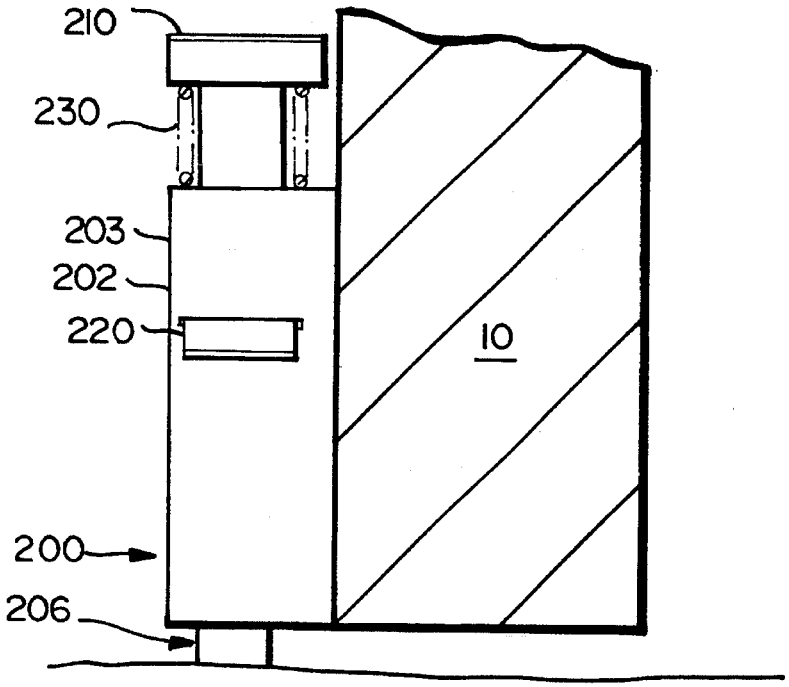
FIG. 6 is an end view of a second embodiment of door holder.

A second embodiment of door holder is now described with reference to FIGS. 6 and 7. Like parts to those in the first embodiment are represented by like reference numerals. The second embodiment is similar to the first embodiment in many fundamental ways.

The basic features of the second embodiment are as follows. The door holder 200 comprises a box 202 that is fixed to a door 10. Removal of lid 203 reveals a battery 281, a Printed Circuit Board 281, and micro-switch 276, which is closed when manual pressure is applied to stay pad (plunger push knob 210). This allows electrical power to flow to the switch 260 (actuating means) and thus put it to "standby". When a local independent fire alarm is sounded, the switch 260 closes and allows power to flow and energize solenoid/motor 250 which releases clasp 220 and allows the stay (plunger 206) to retract by pressure from spring 230. This in turn puts the micro-switch 276 back to "open" and stops the power supply to the solenoid/motor 250. The fire alarm may still be sounding, but as the stay has been released, current drain is essentially nil.

The battery 281 is again calculated to have a life in excess of one year. Piezo transducer 296 sounds a warning when potential in the battery 281 is insufficient to operate the solenoid/motor 250.

LED 298 glows when the switch 260 is energized and therefore at stand-by.

Manual release of the door holder is possible by moving the exposed end of the clasp 220.

Figure 7:
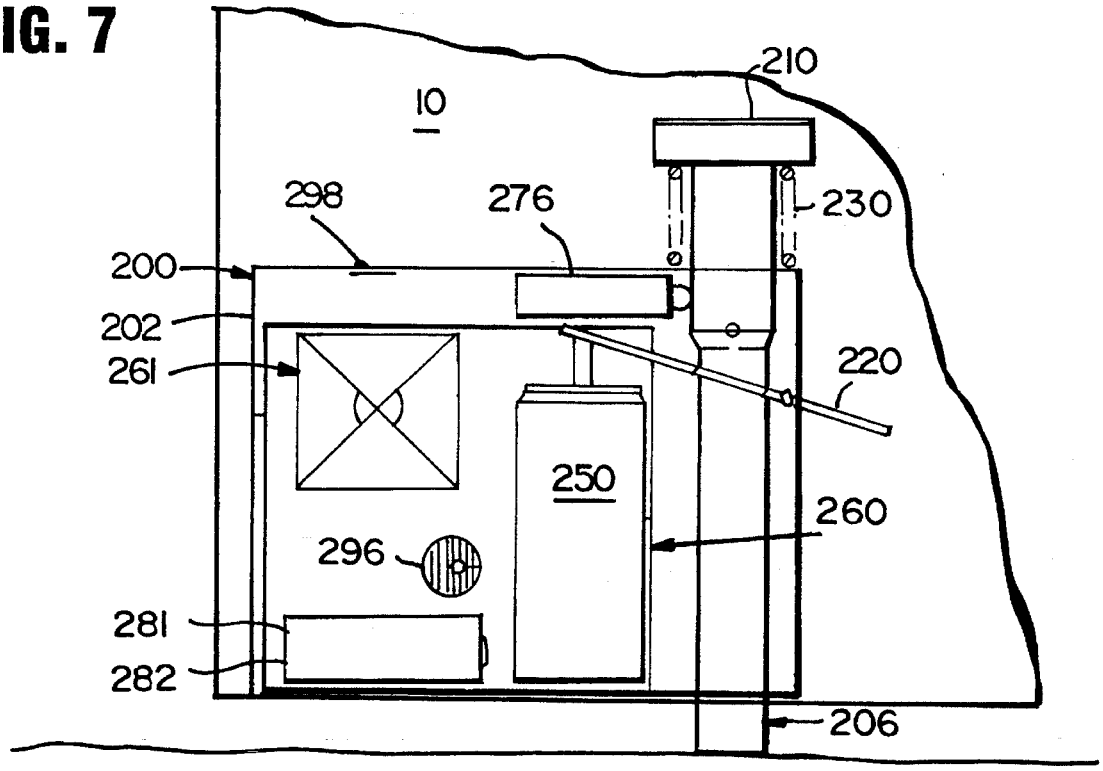
FIG. 7 is a view of the second embodiment similar to that of FIG. 4.

Specific features of note in the second embodiment are firstly that (as shown in FIG. 7) the release arrangement in this embodiment suitably includes a solenoid rather than a motor. Secondly, the spring 230 is in a different location to its location in the first embodiment. Thirdly, the shank of the plunger 206 tapers from a broader to a narrower cross-section in order that depression of the plunger can activate the switch 276.

In a variant of the second embodiment, the box 202 of the door holder is hingedly attached to the door. Thus if, for example, the holder is attached to the outside of the door, the door can be opened (but not closed) even if the plunger is being held depressed.

In another variant, the plunger 206 is provided with a foot which is hingedly attached to the plunger (for example, by a flap of rubber if the foot is made of rubber). This again allows the door to be opened even if the plunger is being held depressed.

In summary, the door holder of the second embodiment has a remotely operated release system. All the constituent parts are within a box which is fixed to a fire door. The sound of the local zone fire alarm activates a switch which allows current from a battery to energise an electro-mechanical device to release a stay.

Figure 8:
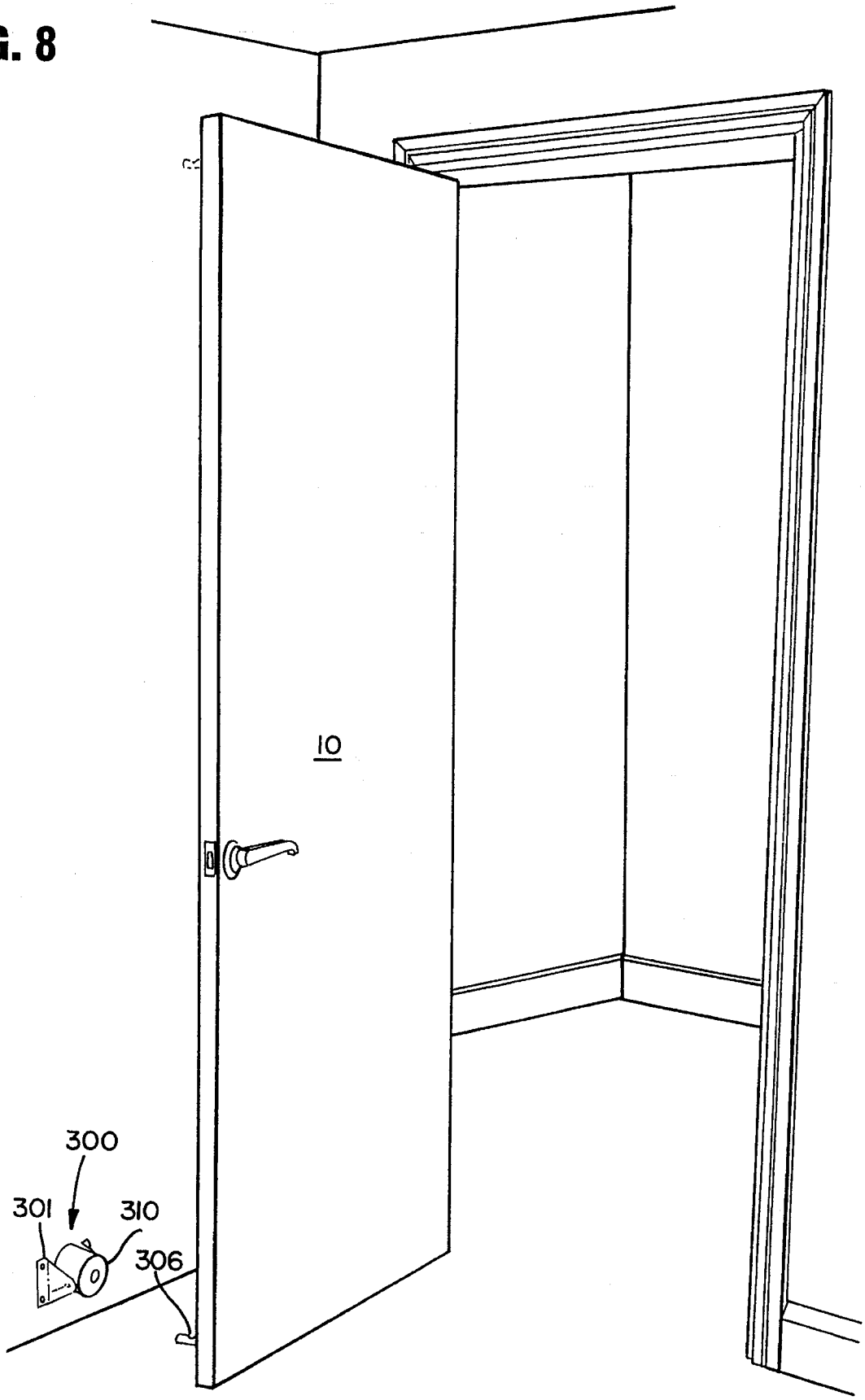
FIG. 8 is a perspective view of a third embodiment of door holder mounted at three different possible positions on a door.
Figure 9:
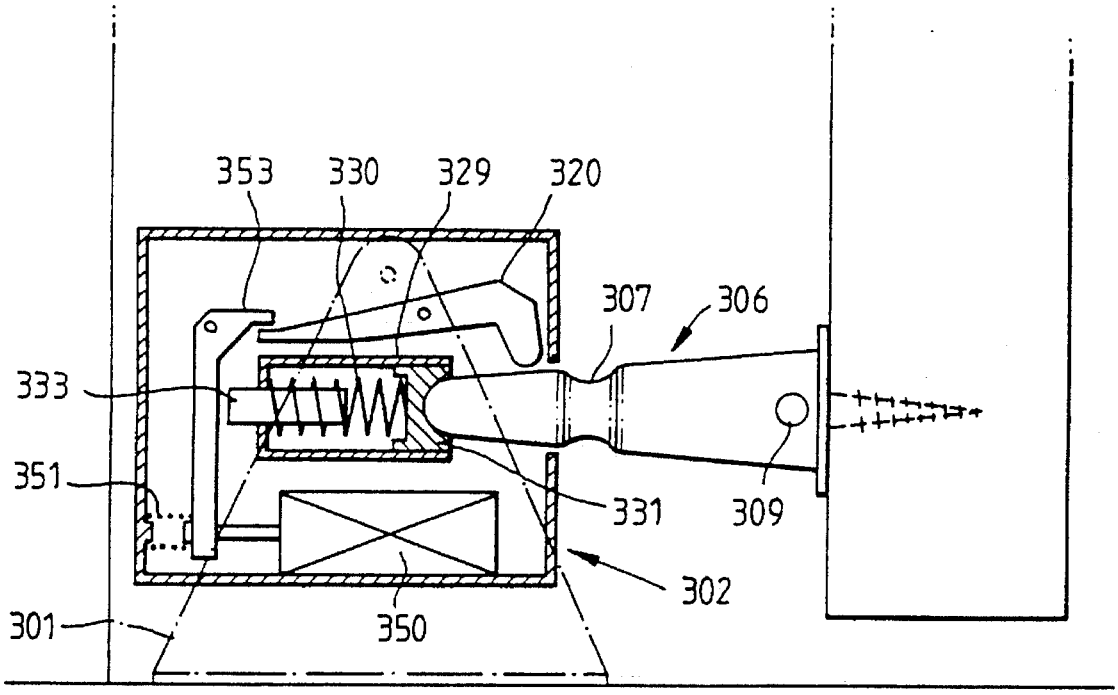
FIG. 9 is a partial side view of the holder showing the interior of the holder.

A third embodiment of door holder is now described with reference to FIGS. 8 and 9. Again, like parts to those in the first embodiment are represented by like reference numerals. In this embodiment, the body 302 of the door holder 300 is wall-mounted rather than door-mounted. Three possible alternative mounting positions include the lower wall mount (as shown), a lower floor mount and an upper wall mount. The door holder includes a tilt-adjustable mounting 301 for versatility.

In the third embodiment, the plunger 306 is completely separable from the body 302 and is door-mounted. It will be understood that the plunger and body need to be aligned on installation. In analogous fashion to the second embodiment, the plunger is engageable with the body and is retained in the body by a clasp and spring forming part of the holding arrangement.

This is explained in more detail with reference to FIG. 9. In the third embodiment, the actuating means is as described previously in relation to the first or second embodiments. A solenoid 350, with a return spring 351, which is in compression, is used as the release arrangement, together with actuating arm 353. The holding arrangement includes a clasp 320 which is engageable in a location groove 307 in the plunger 306 to hold or release the plunger. The actuating arm 353 is so shaped that it can engage with the tail of the clasp to lift the clasp into and out of engagement with the location groove 307. Hence the actuating means can effect holding or release of the plunger.

The plunger 306 is arranged to be engaged in the body 302 against the action of coil spring 330 which is mounted in a fixed spring housing 329 and engages against a spring pad 331 which is slideable in the housing. Thus when the clasp 320 releases the plunger 306, the plunger and hence the door are forced away from the body of the holder by the action of the spring.

The actuating means can also be overridden either by opening or by closing the door. Firstly, the engagement between the clasp 320 and the groove 307 in the plunger is sufficiently weak to allow the door to be pulled away from the body 302 against the action of the clasp. Secondly, if the door is pushed further towards the body against the action of the clasp, the spring pad 331 abuts against a second plunger 333, which is slideable with respect to the spring housing 329 to cause the actuating arm 353 to release the clasp 320. The strength of the spring 330 is sufficient to force the groove in the plunger beyond the reach of the clasp before the clasp has had time to engage with the plunger. It will be understood that this second feature has the advantage of preventing the user slamming the door against the body 302 of the holder, since if the door is slammed too hard the clasp will not engage with the groove 307.

Since the plunger 306 is tapered between the groove 307 and its proximal end, pushing of the door against the body 302 can be arranged to release the door without the use of the second plunger 333.

The plunger 306 has a hole 309 for receiving a bar to turn it to screw it into the door.

In a variant of the third embodiment, a fixed plunger with a male helical thread engages a corresponding female threaded rotatable socket in the body 302 and rotates this socket as the door is pushed against the body. The socket is arranged to be held by the holding arrangement and released in response to the sound of a fire alarm.

The actuating means may be overridden by pulling the door towards the closed position, away from the body. The socket is longitudinally slotted, the arms formed by the slots being retained by a resilient ring around the socket.

A fourth embodiment of door holder is now described with reference to FIGS. 10 and 11. In this embodiment, the actuating means is as described in relation to the first and second embodiments. The workings of the holder are covered with a lid 403. The release arrangement comprises a solenoid 450 which drives a pivotable ratchet lever 420. The holding arrangement includes a foot operable carrier plate 421 which is attached to back plate 423 of the holder by long pins 425. Bushes 427 are slideable along the pins against the action of springs 429. As shown in FIG. 11, the bushes are shaped to be slideable in elongate grooves 431 in the carrier plate. The carrier plate is biassed upwardly by further springs 433. The ratchet lever 420 is engageable in a slot 435 in the carrier plate to hold the carrier plate. More than one slot may be provided.

Figure 10:
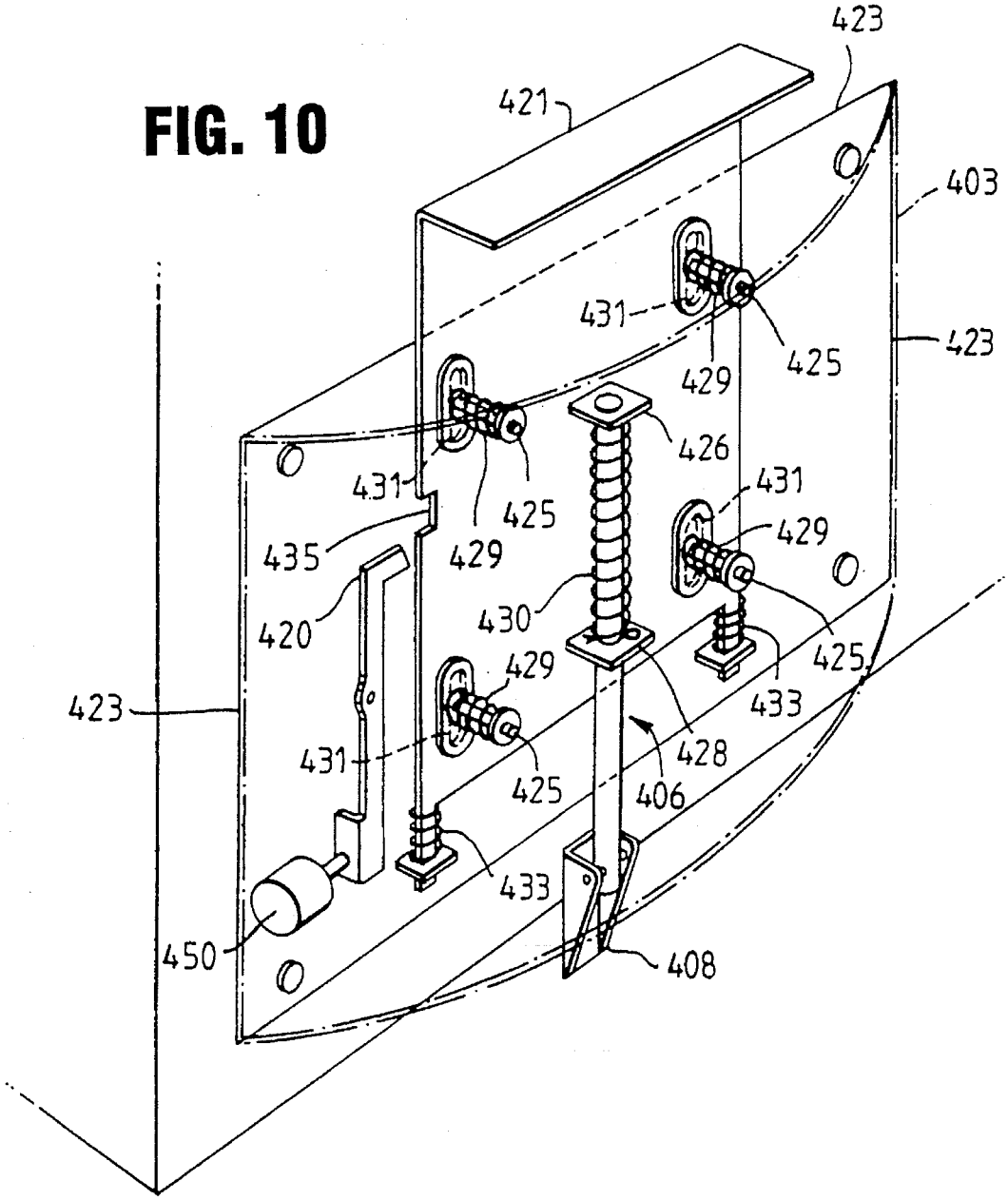
FIG. 10 is a partial perspective view of a fourth embodiment of door holder showing the interior of the holder.
Figure 11:
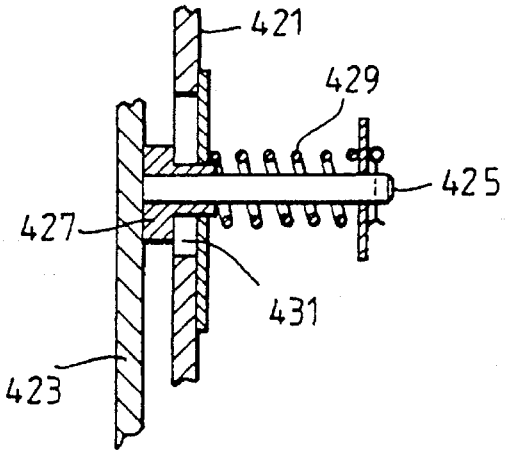
FIG. 11 is a partial sectional view showing a detail of the holder.

A plunger 406 biassed by coil spring (acting against the cotter-pin stop through plunger 406 as shown in FIG. 10 just above bracket (428) is attached to the carrier plate 421 by upper and lower guide brackets 426 and 428. The plunger includes a hinged foot 408.

Operation of the holder in this embodiment is similar to operation of the holder in the first two embodiments. The door holder is set by pressing down with the foot on the carrier plate, which engages the ratchet lever 420 in the slot 435. This downward movement of the carrier plate engages the foot 408 of the plunger 406 with the ground. The loading of spring 430 creates the necessary friction to hold the door in place. Release of the door is effected by release of the ratchet lever 420.

The actuating means can be overridden by opening or closing the door. Movement of the door in one direction (say, to close it) pivots the foot 408 so that the door holder offers no resistance to movement of the door. Movement of the door in the other direction (say, to open it) cannot cause pivoting of the foot, but instead causes pivoting of the entire assembly of carrier plate 421 and plunger 406 against the bias of the springs 429 so that ratchet lever 420 disengages from the slot 435.

It will of course be understood that the present invention has been described above purely by way of example, and modifications of detail can be made within the scope of the invention.

For example, instead of the apparatus being used to release a door, it may be used to cut off a gas supply by turning off a gas valve in response to the warning sound of a gas alarm. This aspect of the invention may have particular applicability in boats or caravans.

The holding and release functions on the valve can be achieved with any of the holding and release arrangements described above (with suitable modification where appropriate). Alternatively the valve may be driven directly by an electric motor as depicted in FIG. 5. The apparatus may be powered by mains electricity rather than batteries if it is mounted in the home, for example.

In one form of this aspect of the invention, a gas alarm system may be provided comprising two main parts. The first part is a gas warning device which makes a specific special warning sound, whilst the second is the apparatus referred to in the preceding paragraph. In this embodiment, the apparatus would only be responsive to the particular sound made by the gas warning device. This would prevent it from triggering due to a different alarm sounding.

As another example, the apparatus may be used to actuate the mains electrical switch for a building if a fire alarm is sensed. This has the advantage that fire-fighters entering a blazing building fitted with this apparatus would not receive any electric shocks. Also, the apparatus may be used to turn off the mains gas supply for the same reasons.

As another example of possible modifications of the invention, if a low battery condition is sensed the apparatus may fail-safe via mechanical rather than electrical means.

As yet another example, the apparatus of the present invention may be incorporated into any appropriate type of door closing mechanism, such as a Perko (trade mark) door closer.

Again, instead of the holding arrangement including a plunger held in place under frictional engagement with a clasp, a ratchet could be arranged to engage with teeth on the plunger. Release of the plunger could be effected by solenoid actuated release of the ratchet.

Again, the safety device could be a roller driven by a clockwork mechanism which is wound up when the door is opened. The mechanism could be actuated to close the door in response to sound of the predetermined character.

Again, deliberate redundancy could be built into the apparatus by providing, for example, two or more actuating means.

Again, instead of being triggered by sound of the predetermined character, the apparatus could be triggered by radio-frequency radiation of a predetermined character such as is emitted by certain types of fire control centres on sensing a fire.

Again, the actuating means might include a timer for actuating the safety device after a predetermined period of time, say, six or eight hours. Thus in the case of a door holder, for example, the door might be opened at the beginning of a day. After the predetermined period (perhaps at night time), the door holder would be actuated automatically to release the door. This is an additional safety feature. The timer could be electrical or mechanical (for example, a clockwork mechanism).

Alternatively or additionally, the actuating means might include a light-sensitive device for actuating the safety device when the ambient light level falls below a predetermined value. Thus, for example, all the fire doors in a building could be arranged to close after dark.

I claim:

1. Apparatus for retaining and releasing a closure, said apparatus comprising:

retaining means actuable between a retaining state in which it can retain the closure open and a release state in which it ceases to retain the closure and hence releases it, a sensor for sensing from the ambient medium an alarm signal transmitted into the ambient medium, and means coupled to the sensor for actuating the retaining means to release the closure in response to the alarm signal.

2. Apparatus as in claim 1 including:

means for overriding the actuating means to permit actuation of the retaining means at will.

3. Apparatus as in claim 2 wherein:

the retaining means includes an engagement formation, for retaining the closure open, which is actuable by the actuating means to release the closure, and the override means is adapted to permit actuation of the retaining means in response to force applied to the engagement formation.

4. Apparatus as in claim 3 wherein the override means is adapted to permit retraction of the engagement formation in response to force applied to the formation.

5. Apparatus as in claim 4 wherein the engagement formation is pivotable, pivoting of the formation being arranged to cause its retraction.

6. Apparatus as in claim 1 including a battery holder arranged to hold a battery to supply power to the actuating means.

7. Apparatus as in claim 6 further including an access door to the battery holder, the actuating means being arranged to actuate the retaining means on opening of the access door.

8. Apparatus as in claim 6 further including a battery condition sensor, the actuating means being arranged to actuate the retaining means if a low battery condition is sensed.

9. Apparatus as in claim 1 further including means for switching off power to the actuating means once the retaining means has been actuated.

10. Apparatus as in claim 1 wherein the actuating means includes a bistable actuator.

11. Apparatus as in claim 1 wherein the retaining means includes an engagement formation, for retaining the closure open, which is actuable by the actuating means to release the closure.

12. Apparatus as in claim 11 wherein the engagement formation is capable of frictional engagement with the ground.

13. Apparatus as in claim 12 wherein the engagement formation has an adjustable reach.

14. Apparatus as in claim 11 wherein the engagement formation is capable of engagement with a cooperating engagement formation.

15. Apparatus as in claim 1 in combination with the closure.

16. Apparatus as in claim 1 wherein the sensor is an acoustic sensor and the actuating means is responsive to sound of a predetermined character.

17. Apparatus as in claim 16 wherein the actuating means is responsive only to sound in one or more predetermined frequency ranges.

18. Apparatus as in claim 16 wherein the actuating means is responsive to sound of a predetermined continuous duration.

19. Apparatus as in claim 16, wherein the actuating means is responsive only to sound above a predetermined intensity threshold.

20. Apparatus as in claim 1 including a battery holder arranged to hold a battery to supply power to the actuating means.

21. Apparatus for retaining and releasing a closure, said apparatus comprising:

retaining means actuable between a retaining state in which it can retain the closure open and a release state in which it ceases to retain the closure and hence releases it, a sensor for sensing from the ambient medium an alarm signal transmitted into the ambient medium, means coupled to the sensor for actuating the retaining means to release the closure in response to the alarm signal, and means for overriding the actuating means to permit actuation of the retaining means at will, wherein the retaining means includes an engagement formation, for retaining the closure open, which is actuable by the actuating means to release the closure, and the override means is adapted to permit actuation of the retaining means in response to force applied to the engagement formation, wherein the override means is adapted to permit actuation of the retaining means both in response to an opening force and in response to a closing force applied to the engagement formation in respective mutually opposed directions.

22. A closure in combination with apparatus for retaining and releasing the closure, said apparatus comprising:

retaining means actuable between a retaining state in which it can retain the closure open and a release state in which it ceases to retain the closure and hence releases it, a sensor for sensing from the ambient medium an alarm signal transmitted into the ambient medium, and means coupled to the sensor for actuating the retaining means to release the closure in response to the alarm signal, wherein the actuating means can be overridden either by opening or closing the closure.

23. Valve apparatus comprising:

a valve, a sensor for sensing from the ambient medium an alarm signal transmitted into the ambient medium, and actuating means coupled to the sensor for closing the valve in response to the alarm signal.

24. Apparatus as in claim 23 wherein the valve is a gas valve.

25. Apparatus as in claim 23 including:

means for overriding the actuating means to permit actuation of the valve at will.

26. Apparatus as in claim 23 including:

a battery holder arranged to hold a battery to supply power to the actuating means.

27. Apparatus as in claim 26 further including:

an access door to the battery holder, the actuating means being arranged to actuate the valve on opening of the access door.

28. Apparatus as in claim 26 further including:

a battery condition sensor, the actuating means being arranged to actuate the valve if a low battery condition is sensed.

29. Apparatus as in claim 23 further including:

means for switching off power to the actuating means once the valve has been actuated.

30. Apparatus as in claim 23 wherein the actuating means includes a bistable actuator.

31. A kit of parts including valve apparatus as in claim 23 and a warning device for generating the alarm signal.

32. Apparatus as in claim 23 wherein the sensor is an acoustic sensor and the actuating means is responsive to sound of a predetermined character.

33. Apparatus as in claim 32 wherein the actuating means is responsive only to sound in one or more predetermined frequency ranges.

34. Apparatus as in claim 32 wherein the actuating means is responsive to sound of a predetermined continuous duration.

35. Apparatus as in claim 32 wherein the actuating means is responsive only to sound above a predetermined intensity threshold.

36. Apparatus as in claim 23 including a battery holder arranged to hold a battery to supply power to the actuating means.

* * * * *